US006009917A

United States Patent [19]

Meyns et al.

[11] Patent Number: 6,009,917

[45] Date of Patent: Jan. 4, 2000

[54] SELVEDGE-FORMING DEVICE WITH INDEPENDENT CONTROL AND ECCENTRIC DRIVE SYSTEM

[75] Inventors: Ignace Meyns, Reninge; Kurt Slosse, Boezinge, both of Belgium

[73] Assignee: Picanol N.V., Ypres, Belgium

[21] Appl. No.: 09/117,545

[22] PCT Filed: Feb. 4, 1997

[86] PCT No.: PCT/EP97/00495

§ 371 Date: Nov. 20, 1998

§ 102(e) Date: Nov. 20, 1998

[87] PCT Pub. No.: WO97/29232

PCT Pub. Date: Aug. 14, 1997

[30] Foreign Application Priority Data

Feb. 9, 1996 [BE] Belgium ..... 9600115

[51] Int. Cl.[7] ..... D03D 47/40

[52] U.S. Cl. ..... 139/54; 139/430

[58] Field of Search ..... 139/54, 430

[56] References Cited

U.S. PATENT DOCUMENTS

| | | | |
|---|---|---|---|
| 4,007,762 | 2/1977 | Van Donk | 139/54 |
| 5,123,454 | 6/1992 | Debaes | 139/54 |
| 5,419,375 | 5/1995 | Corain et al. | 139/54 |

*Primary Examiner*—Andy Falik
*Attorney, Agent, or Firm*—Bacon & Thomas, PLLC

[57] ABSTRACT

A selvage-forming device (1) for a loom includes yarn guide structures (2, 3, 5) to guide at least two selvage yarns (8, 11) that are alternating raised and lowered to form a selvage shed (12). These yarn guide structures are powered through the intermediary of eccentrics driven by their own independently controlled drive (13) and an eccentric drive coupling-bracket (16) that creates a motion by which one selvage yarn (8) is additionally shifted transversely to form mutually crossing interlacings.

22 Claims, 10 Drawing Sheets

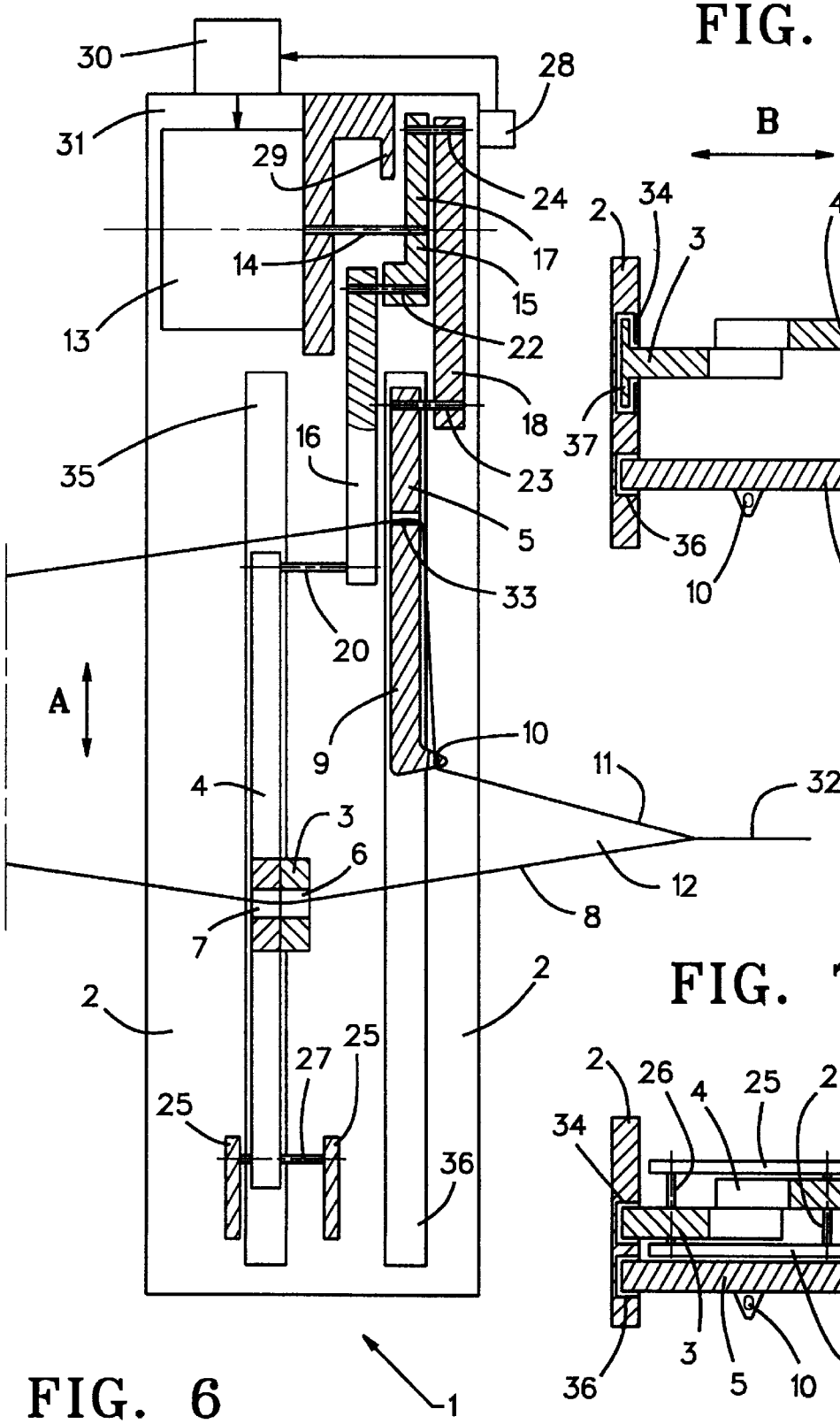
FIG. 6
FIG. 9
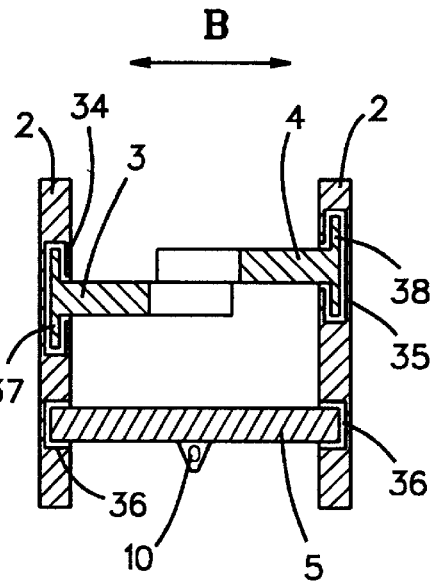
FIG. 7
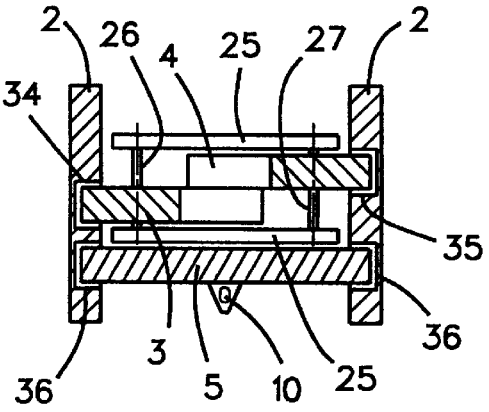

SELVEDGE-FORMING DEVICE WITH INDEPENDENT CONTROL AND ECCENTRIC DRIVE SYSTEM

BACKGROUND OF THE INVENTION

1. Field of the Invention

The invention relates to a selvage-forming device for a power loom, with yarn guide structures to raise and lower at least two selvage yarns.

2. Related Art

Selvage-forming devices cooperating with selvage yarns are used in looms to form a fabric selvage or a waste band. The selvage yarns are guided in yarn guide structures which raise and lower these yarns to subtend sheds in which the fillings are laced into the selvage yarns in a predetermined pattern. The yarn guide structures usually are fitted with yarn guide elements in the form of circular, oval or slotted apertures. The selvage yarns also are called catch threads.

Selvage-forming devices for at least two selvage yarns are known. Therein a first selvage yarn is moved up and down in one plane while a second selvage yarn is moved up and down in the opposite direction to the first one and simultaneously is displaced transversely to the plane of the up-and-down motion, whereby the two selvage yarns cross each other.

The known selvage-yarn devices contain a needle moving in a plane and comprising an eye guiding a first selvage yarn. Moreover they contain two yarn guide structures fitted with crossed slots to guide a second selvage yarn and which are displaced oppositely to the needle. In the process the yarn guide structures with the crossed slots also move relative to each other, and, because of the relative displacement of the slots, the second selvage yarn is shifted perpendicularly to the above-mentioned plane, and as a result the two selvage yarns will cross.

Such a selvage-forming device is described in U.S. Pat. No. 4,478,256. The selvage-forming device is driven jointly with the loom's harnesses. Accordingly this selvage-forming device only allows interlacings, i.e. weaves, which are determined by the paths of the harnesses. Another selvage-forming device is disclosed in U.S. Pat. No. 3,171,443 and is driven by the same drive elements of the loom drive system. The drive is fairly complex. A change in interlacing is possible only after substantial labor.

The object of the invention is to create a selvage-forming device of the type discussed above that allows changing in a simple manner the weave of selvage yarns and fillings. cl Summary of the Invention This problem is solved by providing an independently controlled drive to raise and lower the selvage yarns in a mutually opposite manner by means of eccentric drives that are connected to the linearly guided yarn guide structure. The yarn guide structures of at least one selvage yarn implement the crossing of this selvage yarn while it is being raised and lowered with another selvage yarn transversely to the direction of raising and lowering. The motion of the yarn guide structure required to cross the at least one selvage yarn is derived from the eccentric drive associated with said selvage yarn.

The invention makes it possible to change the weave of selvage yarns and inserted fillings in a simple manner in the case of consecutive filling insertions because only the drive control need be changed. As regards consecutive insertions of fillings, the number of fillings interlaced with the selvage yarns and/or the kind of mutual crossing of selvage yarns can easily be changed.

A selvage-forming device according to the invention offers the advantage of being highly compact and constituted of few parts. It can be implemented in modular form. Moreover it can be installed and disassembled in a simple manner and furthermore it can be shifted width-wise of the power loom when the fabric width is changed.

BRIEF DESCRIPTION OF THE DRAWINGS

Further advantages and features of the invention are elucidated below in the description of illustrative embodiments and in relation to the attached drawings.

FIG. 6 is a section along line VI—VI of FIG. 1, the distances between the individual components in the direction of motion of the selvage yarns being exaggerated for clarity, FIG. 7 shows a section along line VII—VII of FIG. 2, FIG. 9 is a section along Line IX—IX of FIG. 8, FIGS. 10, 11 are weave patterns of selvage yarns and fillings made possible by the selvage-forming device of FIGS. 1 through 6.

DETAILED DESCRIPTION OF PREFERRED EMBODIMENTS OF THE INVENTION

Figure 10:
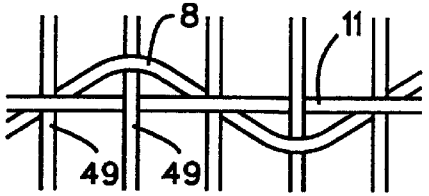
Figure 11:
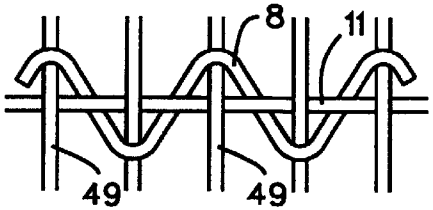
Figure 13:
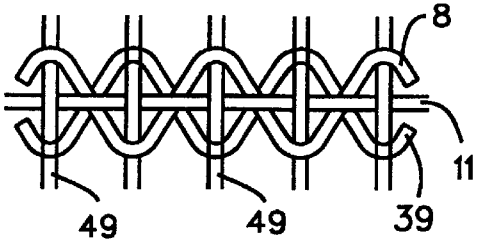
FIG. 13 is a weave of selvage yarns and fillings implemented by the embodiment of FIG. 12.
Figure 15:
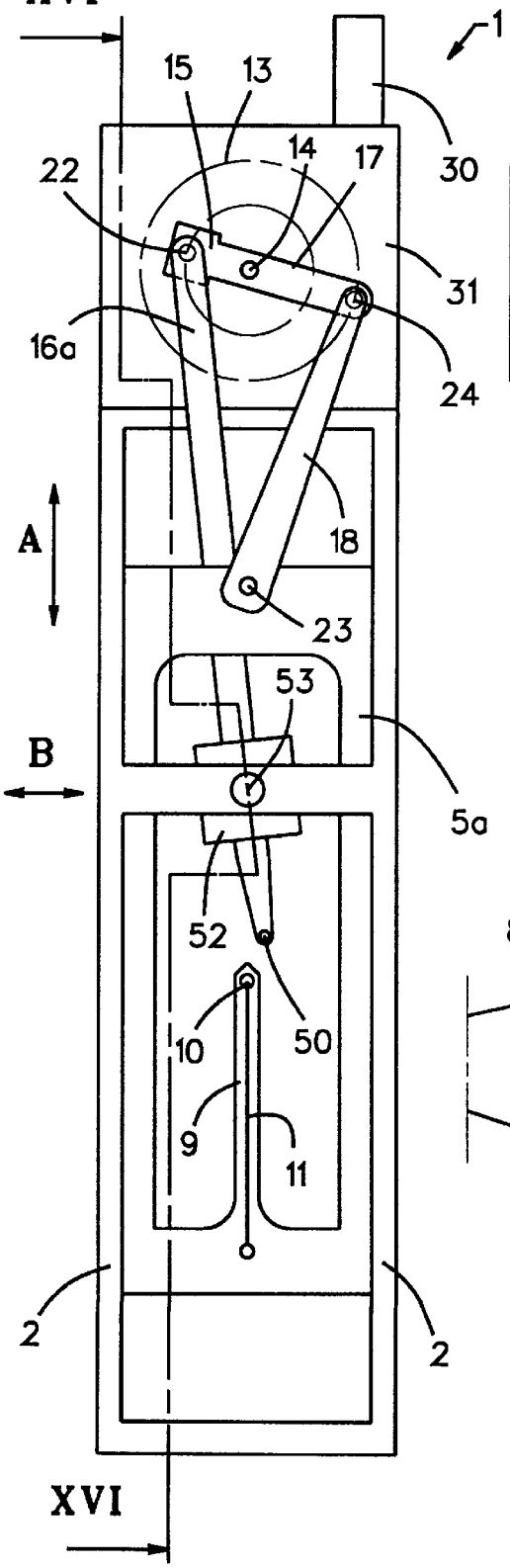
FIG. 15 is a further embodiment of a selvage-forming device of the invention.

The selvage-forming device 1 shown in FIGS. 1 through 7 comprises two lateral guide segments 2 within which three yarn guide structures or devices 3, 4 and 5 are guided in the longitudinal or vertical (up and down) direction A. Two selvage yarns 8 and 11, each from a particular yarn supply, especially a bobbin, are consecutively raised and lowered in the longitudinal direction A in order to subtend consecutive selvage sheds 12 (FIG. 6). The yarn guide structures 3 and 4 each contain a slot 6, 7. The slots 6, 7 of the consecutively mounted yarn guide structures 3, 4 run in mutually opposite directions and obliquely to the longitudinal direction A. The slots 6, 7 guide a selvage yarn 8. When the yarn guide structures 3, 4 and hence the slots 6, 7 are moved mutually oppositely in the longitudinal direction A, the slots 6, 7 move the selvage yarn 8 in the transverse direction B, that is transversely to the longitudinal direction A. The yarn guide structure 5 contains a needle 9 fitted at its end with a yarn eye 10 guiding a selvage yarn 11. The selvage yarns 8 and 11 are moved oppositely to each other in the longitudinal direction A, that is they are being raised and lowered, in order to form in each case a shed 12 which shall receive a filling. Thereupon a new shed is formed, that is, following the insertion of one or more fillings, the selvage yarns 8, 11 together with the filling(s) will form a selvage weave. In the process the selvage yarns 8, 11 rest around the filling(s) in the manner furthermore shown in FIGS. 10, 11 and 13. In addition to such looping, the invention also provides that at least one of the selvage yarns 8 or 11 be alternatingly displaced in the transverse direction so that they shall cross and loop each other, again as shown in FIGS. 10, 11 and 13.

The selvage-forming selvage device 1 contains an independently controlled drive 13, for instance an electric drive motor controlled independently of the loom drive by (not shown) means to make sheds from warps. By means of a drive shaft 14, the drive 13 actuates eccentric drives moving the yarn guide structures 3, 4 for the selvage yarn 8 and the selvage yarn 11 up and down in mutually opposite motions. An eccentric drive comprises a crank 15 of which the end is connected to a coupling bracket 16 linked to the yarn guide structures 3, 4. In this embodiment the eccentric drive comprises a Y-shaped crank bracket 16 and is connected at the connection points 19, 20 to the yarn guide structures 3, 4 which are angularly configured relative to the axis of rotation of the eccentric drive, that is relative to the drive shaft 14. The connection points 19, 20 thereby are located opposite each other relative to a plane of symmetry 21 extending through and including drive shaft 14. As a result, while the yarn guide structures 3, 4 are raised and lowered simultaneously, each will however follow a somewhat different path. Thereby the two yarn guide structures 3, 4 move relatively to each other during the raising and lowering motions in the longitudinal direction A, and consequently the slots 6, 7 also are moved relatively to each other in the longitudinal direction A. The slots 6, 7 are configured in such a way that parts of them always will overlap. The overlapping parts of the slots 6, 7 depend on the relative position of the yarn guide structures 3, 4 and hence of the slots 6, 7 in the longitudinal direction A. For the position shown in FIG. 1, the central parts of the slots 6, 7 will overlap, whereas at the largest relative displacements corresponding to the positions of FIGS. 2 and 4 the right ends or the left ends of the slots 6, 7 will overlap. Because the selvage yarn 8 always paper through the zone where the slots 6, 7 are overlapping, the yarn will be correspondingly shifted in the transverse direction B relatively to the longitudinal direction A. To achieve this transverse shifting, the radial length of the crank 15, the length of the coupling bracket 16, the position of the linkage points 19, 20 and the length in the longitudinal direction A of the slots 6 and 7 are made to match one another.

The drive shaft 14 drives the yarn guide structure 5 by means of a, another eccentric drive. This eccentric drive contains a crank 17 mounted on the drive shaft 14 and in this embodiment is integral (one piece) with the crank 15, the end of said crank 15 being linked at a linkage point 24 to a coupling rod of bar 18 of which the free end is linked by a linkage point 23 to the yarn guide structure 5. The linkage point 24 of the coupling bar 18 is essentially diametrically opposite in relation to the drive shaft 14 to the linkage point 22 of the coupling bracket 16 and as a result, when the drive shaft 14 rotates the cranks 15, 17, the yarn guide structures 3, 4 on one hand and the yarn guide structure 5 on the other hand move with maximum excursion in opposite directions.

Figure 3:
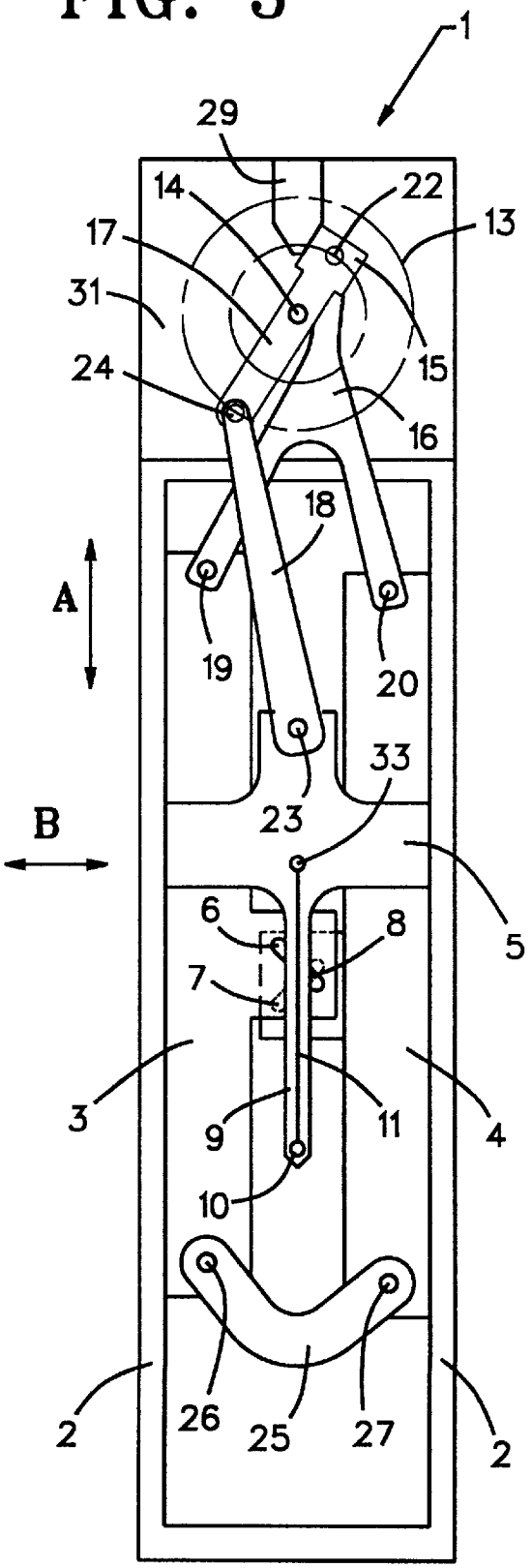
Figure 4:
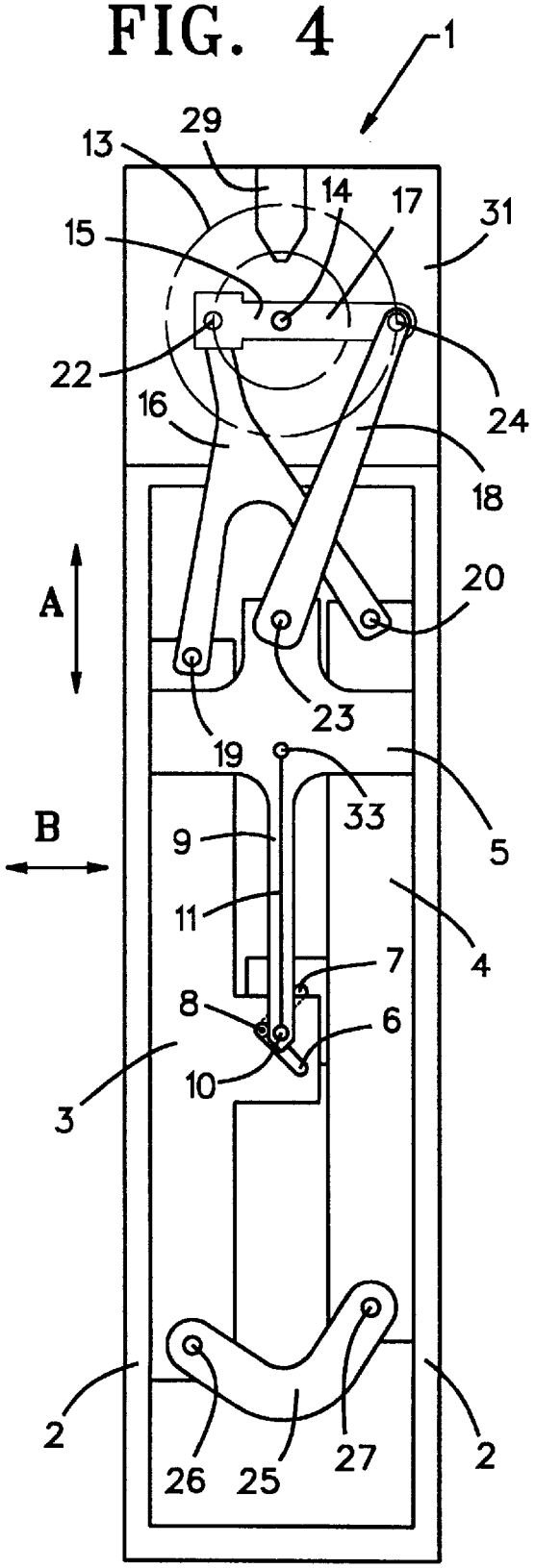
Figure 5:
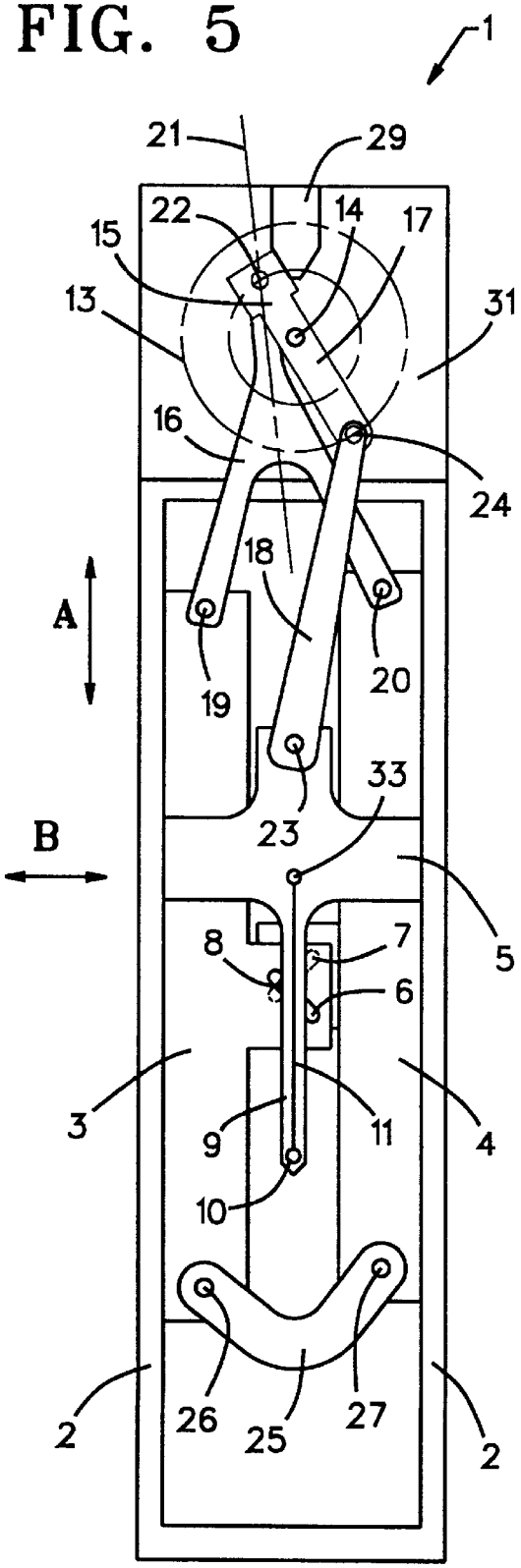

The angle of rotation of the drive 13 is restricted to a range less than 360°, that is to about 350°, as indicated by the positions of FIGS. 3 and 5. For that purpose the crank 15 is fitted with a stop 29. The drive 13, in particular a stepping motor, is controlled by a control unit 30 that controls the direction of rotation, the path to be covered and also the speed.

The side guide segments 2 are part of a frame 31 also holding the drive 13. The yarn guide structure 5 is in the shape of a yoke guided in two longitudinal channels 36 of the side segments 2 and forming a linear guide for the yarn guide structure 5. The yarn guide structure 5 comprises an eye 33 in the extension of the needle 9 to guide the selvage yarn 11. The yarn eye 10 is somewhat offset from the needle 9 in the direction of motion of the selvage yarn 11 toward the fabric 32 (FIG. 6), and as a result the selvage yarn 11 does not make contact in the vicinity of the needle 9 and is easily threaded from the side of the fabric 32.

The two side segments 2 each comprise a longitudinal channel 34, 35 constituting a linear guide for the yarn guide structures 3, 4 which thereby are guided only unilaterally. Besides being connected by the Y-shaped coupling bracket 16, the two yarn guide structures 3, 4 are connected in their area away from the coupling bracket 16 by two links bracket 25 linked at linkage sites 26, 27 to the yarn guide structures 3, 4.

Figure 8:
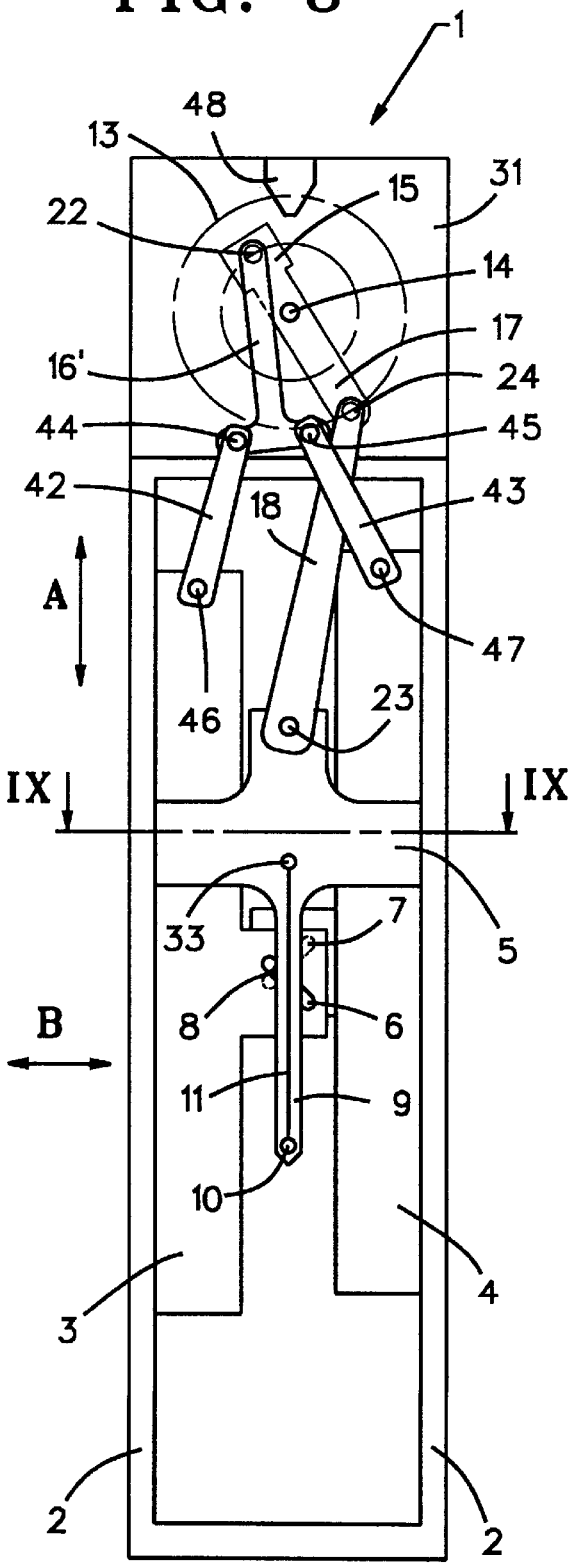
FIG. 8 is an embodiment variation of a selvage-forming device in a position corresponding to FIG. 5.

The embodiment of the invention of FIGS. 8 and 9 substantially corresponds to that of FIGS. 1 through 7 except that the Y-shaped coupling bracket is replaced by a shorter T-shaped coupling bracket 16' linked by two further coupling rods or bars 42, 43 to the yarn guide structures 3, 4. The coupling bar 42 linked at one linkage point 44 to the coupling bracket 16' and at one linkage point 46 to the yarn guide structure 3, and the coupling bar 43 linked at one linkage point 45 to the coupling bracket 16' and at one linkage point 47 to the yarn guide structure 4, make possible compensation whereby the yarn guide structures 3, 4 can be guided by T-shaped ends 37, 38 in undercut channels 34, 35 of the side segments 2. The same effect also can be achieved if, in an embodiment not shown, the Y-shaped coupling bracket 16 of the embodiment of FIGS. 1 through 7 is replaced by two separate coupling bars of which one connects the linkage point 22 of the crank 15 to the linkage point 19 of the yarn guide structure 3 and the other connects the linkage point 22 of the crank 15 to the linkage point 20 of the yarn guide structure 4. In this embodiment, the crank 17 is combined with a stop 48.

When using a Y-shaped coupling bracket 16 corresponding to the embodiment of FIGS. 1 through 7, the distance between the linkage points 19, 20 as seen in the transverse direction B will change during the motion of the corresponding eccentric drive. This change in distance can be absorbed by the play in the guide channels 34, 35 and/or by elastic deformation of the coupling bracket 16 and/or by elastic deformation of the brackets 25. Moreover the guide channels 34, 35 may also be made to slightly curve relative to each other in an upper and lower zone to compensate thereby the change in distance between the linkage points 19, 20.

Figure 1:
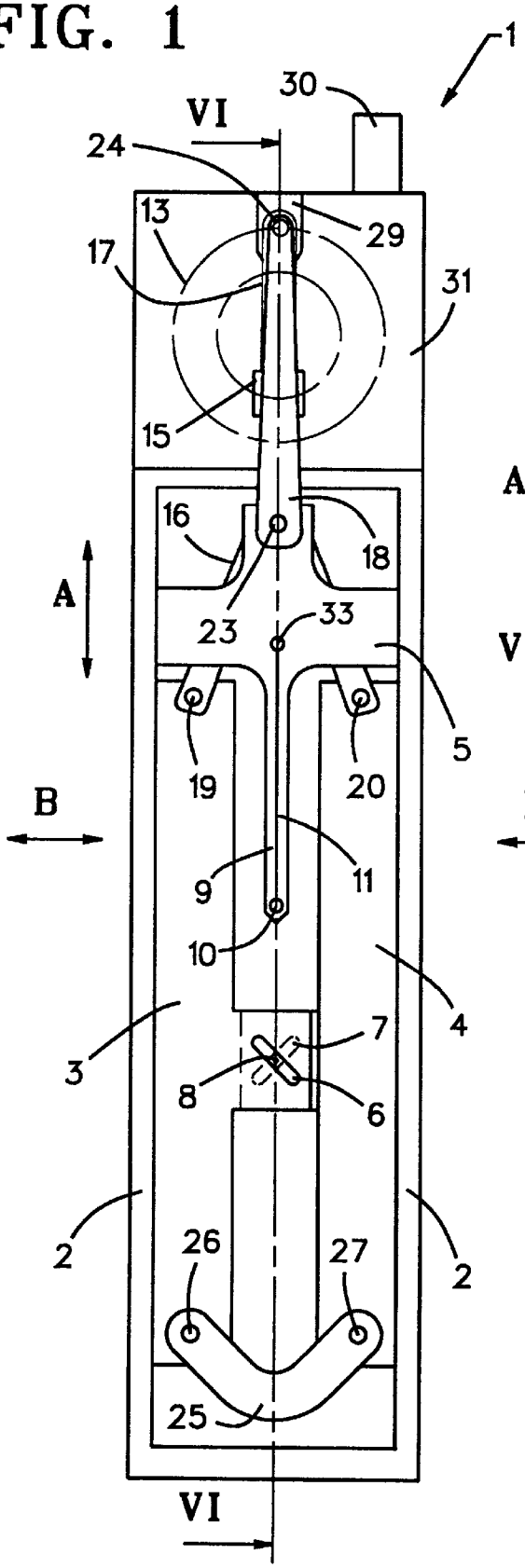
FIG. 1 is a schematic elevation of a selvage-forming device of the invention as viewed in the direction of motion of the selvage yarns.
Figure 2:
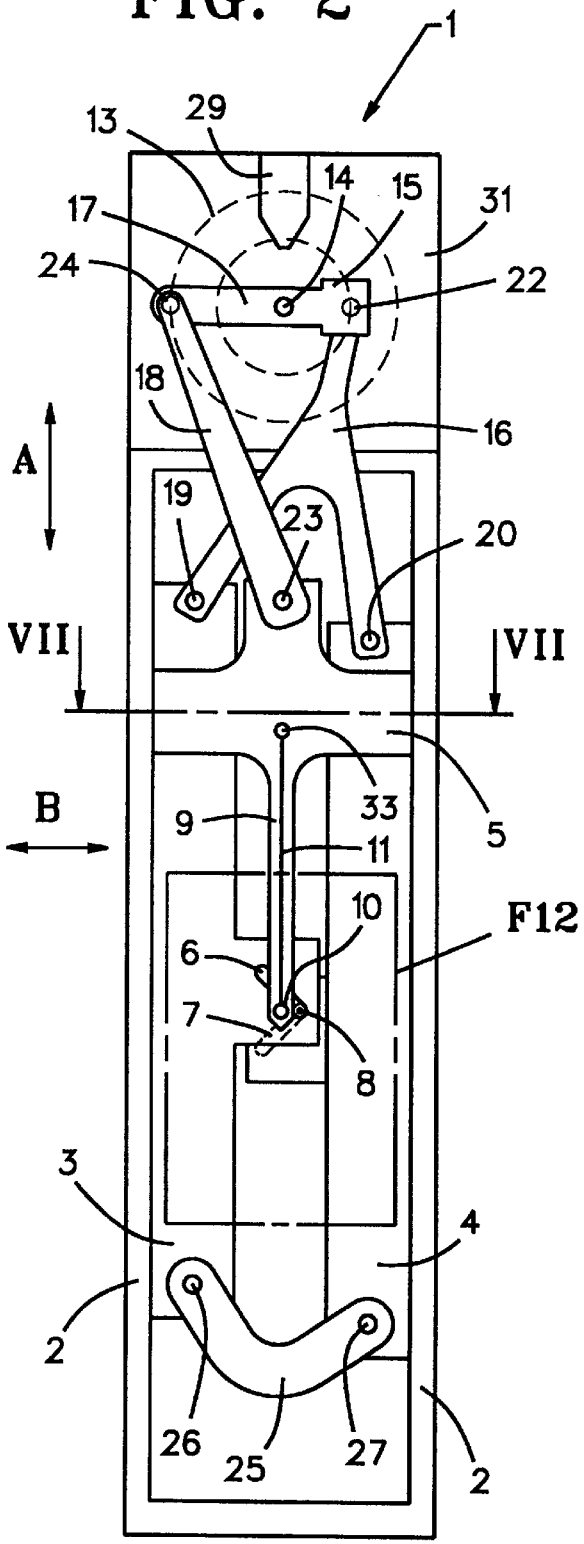
FIGS. 2–5 show the selvage-forming device of FIG. 1 in various positions.

An open shed 12 is present in the embodiment of FIGS. 1 through 7 (and correspondingly also in the embodiment of FIGS. 8 and 9), namely in the positions of FIG. 1, FIG. 3 and FIG. 5, whereby a filling 49 can be inserted in each of these three positions. Upon presetting the control unit 30, a predetermined pattern may be used selectively in each of these positions, said patterns being easily modified at the control unit 30. If for instance the positions of FIG. 1, FIG. 3 and FIG. 5 are consecutively used to insert fillings (FIG. 10), and a filling 49 is inserted in each of these positions, the weave pattern shown in FIG. 10 will result, wherein the selvage yarn 8 is to the side of the selvage yarn 11 only at every second filling insertion. If on the other hand the positions of FIGS. 3 and FIG. 5 are consecutively used for filling insertion, a weave pattern as shown in FIG. 11 will result, wherein the selvage yarn 8 is to the side of the selvage yarn 11 at every filling insertion. Starting with the position of FIG. 1, the position of FIG. 2 or the position of FIG. 4 can be selectively used by appropriately rotating the drive shaft 14 so that the selvage yarn 8 is shifted selectively to the right or left of the selvage yarn 11.

Moreover, the fillings may be inserted only in the positions of FIG. 1 and FIG. 3 for instance in the case of a predetermined number of filling insertions and thereupon the procedure may be changed to filling insertions in the position of FIG. 1 and FIG. 5. All these procedures are easily selected by adjusting the control unit 30.

Figure 12:
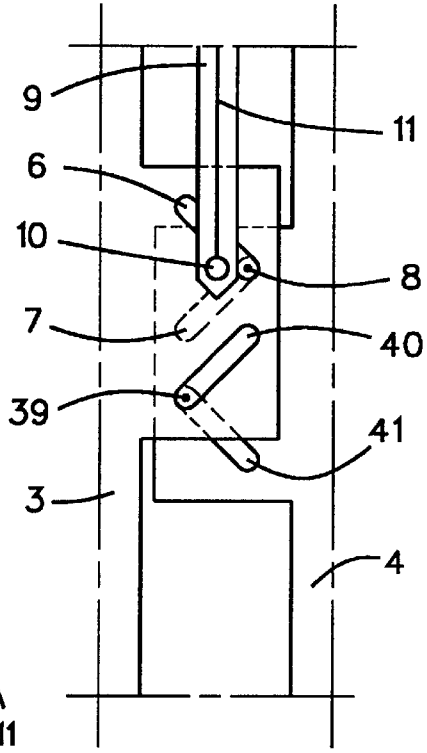
FIG. 12 shows on an enlarged scale an embodiment variation of the segment F12 of FIG. 2.

As shown in FIG. 12, the embodiment of FIGS. 1–7 or FIGS. 8 and 9 can be modified in simple manner in that the yarn guide structures 3, 4 are fitted with two pairs of slits 6,7 and 40, 41 configured one behind the other in the longitudinal direction A and each receiving one selvage yarn 8, 39. The slots 6, 40 and 7, 41 of the yarn guide structures 3, 4 are mutually opposite and oblique so that the selvage yarns 8, 39 are shifted in each instance in mutually opposite manner in the transverse direction B relative to the selvage yarn 11. If in this instance the positions of FIG. 3 and FIG. 5 are used for filling insertion, a weave pattern corresponding to FIG. 13 may be made.

Figure 14:
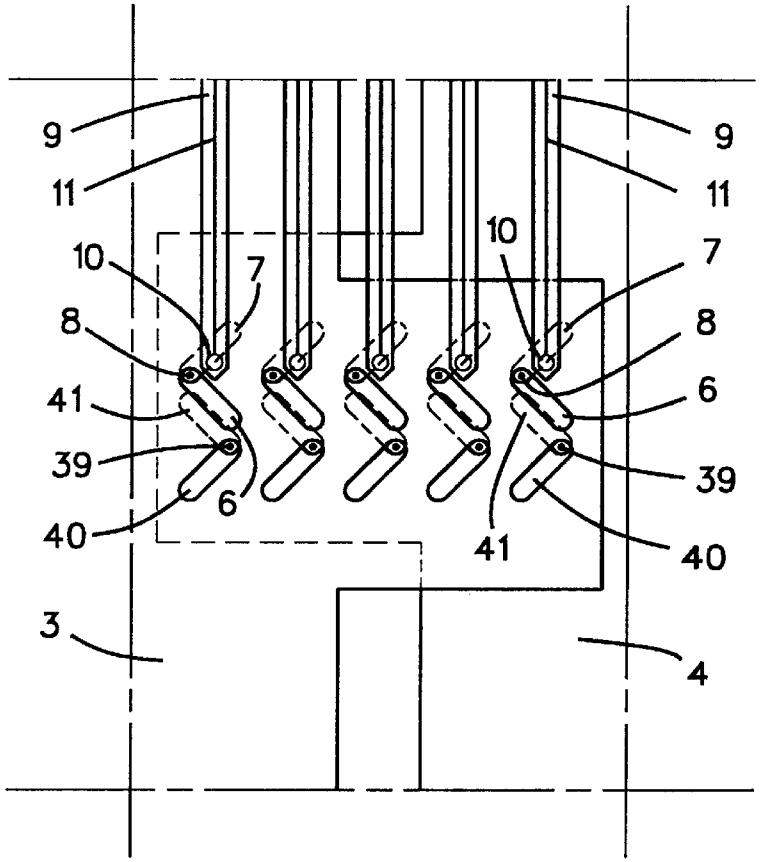
FIG. 14 is an enlarged view similar to the segment F12 of FIG. 2 for another embodiment variation.

As shown in FIG. 14, the embodiment of FIGS. 1–7 or of FIGS. 8 and 9 can be easily modified by fitting the yarn guide structures 3, 4 with several pairs of slots 6, 7 mounted adjacent to each other in the transverse direction and each receiving one selvage yarn 8. A needle 9 with eye 10 to guide selvage yarns 11 is associated to each of said pairs of slots. As further shown in FIG. 14, it is easily possible not only to configure several pairs of slots 6, 7, adjacent to each other in the transverse direction B, in the yarn guide structures 3, 4, but also several pairs of slots 6, 7 and 40, 41 below each other in the longitudinal direction A and each receiving a selvage yarn 8, 39.

Again yarn guide structures for the selvage yarns are raised and lowered by cam drives in the embodiments of selvage-forming devices 1 of the invention shown in FIGS. 15 through 24, and furthermore the motion by which at least one selvage yarn shall be shifted transversely in order to transversely cross the other selvage yarn may also be derived from an eccentric drive.

In the embodiment of FIGS. 15 through 18, the coupling bar 16*a* of one of the eccentric drives and driven by the crank 15 is fitted with a yarn guide element in the form of an eye 50, whereby this coupling bar 16*a* per se is designed to be a yarn guide structure. The coupling bar 16*a* designed as a yarn guide structure is guided inside a guide bush 52 acting as a linear guide means for the coupling bar 16*a*. The guide bush 52 is rotatable about a shaft 53 mounted in stationary manner to the frame 31. The end of the coupling bar 16*a* projecting from the guide bush 52 and fitted with the eye 50 can be displaced over a substantial excursion in the direction B transversely to the longitudinal direction A. The selvage yarn 8 guided by the eye 50 moves transversely to the second selvage yarn 11 during the raising and lowering procedure and is guided by an eye 10 in a needle 9 projecting from a yoke-shaped yarn guide structure 5*a*. The yarn guide structure 5*a* is guided inside linear guide means (longitudinal channels) of the side segments 2 of a frame 31. A coupling bar 18 of a second eccentric drive acts on said yarn guide structure 5*a* and is linked to a crank 17 driven by the drive shaft 14.

Figure 18:
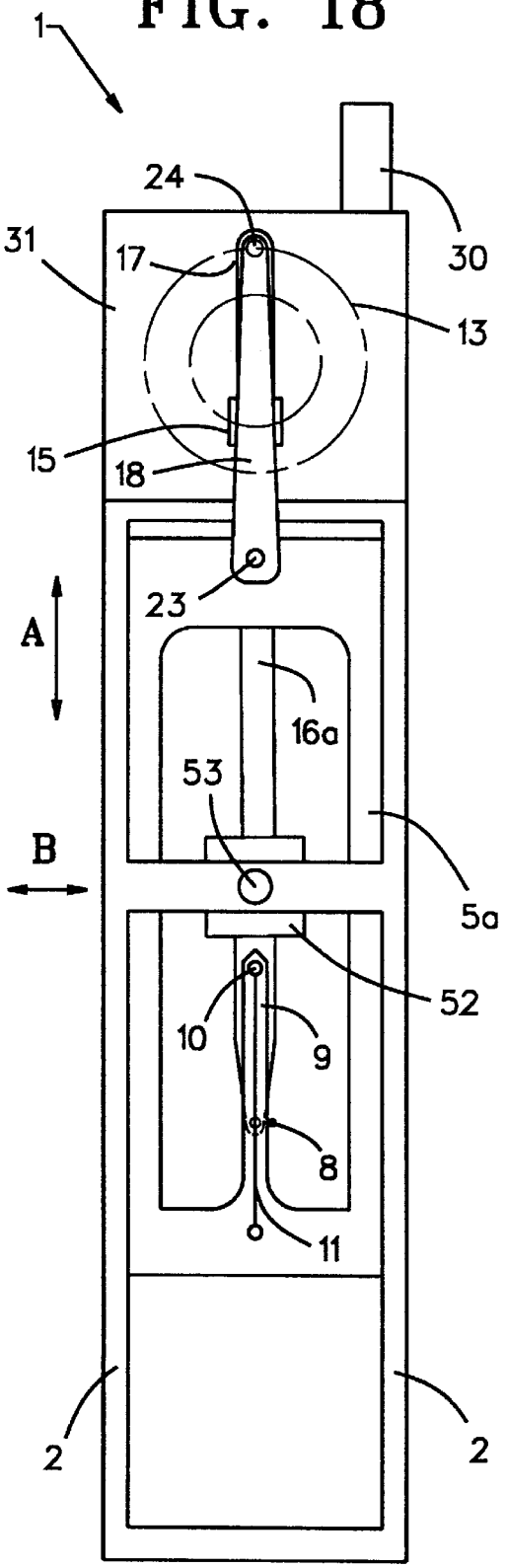

A shed 12 for receiving filling insertion is formed in the position shown in FIG. 18. Based on this position, the drive 13 can be controlled in such manner that the position of FIG. 15 or the position of FIG. 17 can be selected. The selvage yarn 8 running through the eye 50 of the coupling bar 16*a* thereby can be selectively shifted to the right or left of the needle 9. In this manner various weaves can be implemented.

Figure 16:
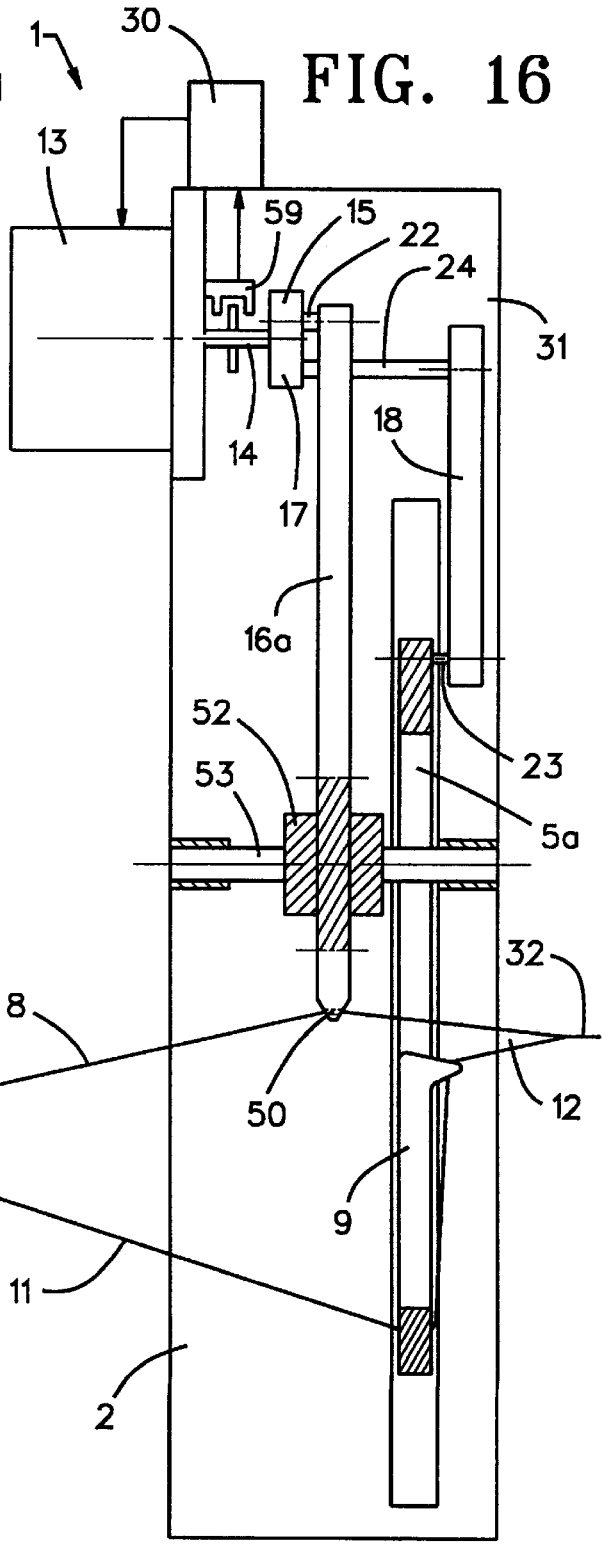
FIG. 16 is a section along line XVI—XVI of FIG. 15, FIGS. 17, 18 show the selvage-forming device of FIG. 15 in different positions.
Figure 17:
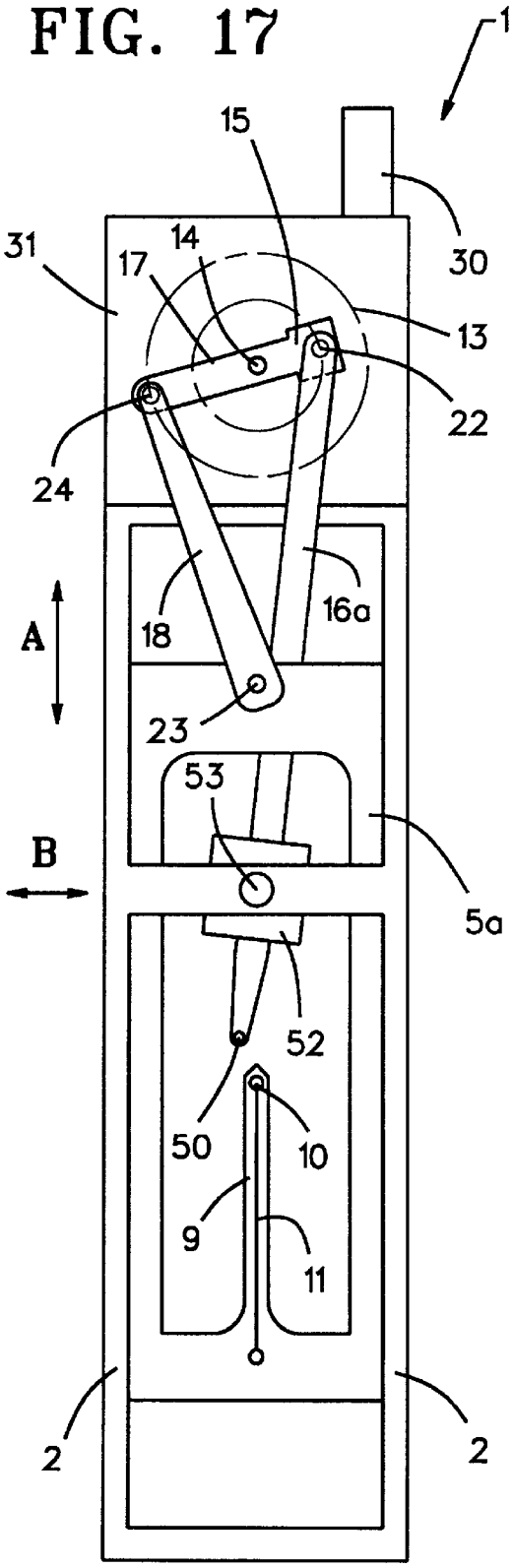

As shown in FIG. 16, the drive shaft 14 of the drive 13 of this embodiment is combined with a position sensor 59 outputting a position signal and connected to the control unit 30. This position sensor 59, for instance an incremental generator, allows using illustratively a servomotor as a drive 13 and thereby to accurately move the servomotion to the desired position. It is thereby possible to omit the stop for limiting the angle of rotation. If such a position sensor 59 is cooperating with a stepping motor, then obviously a stop otherwise required for adjustment can be eliminated.

Figure 19:
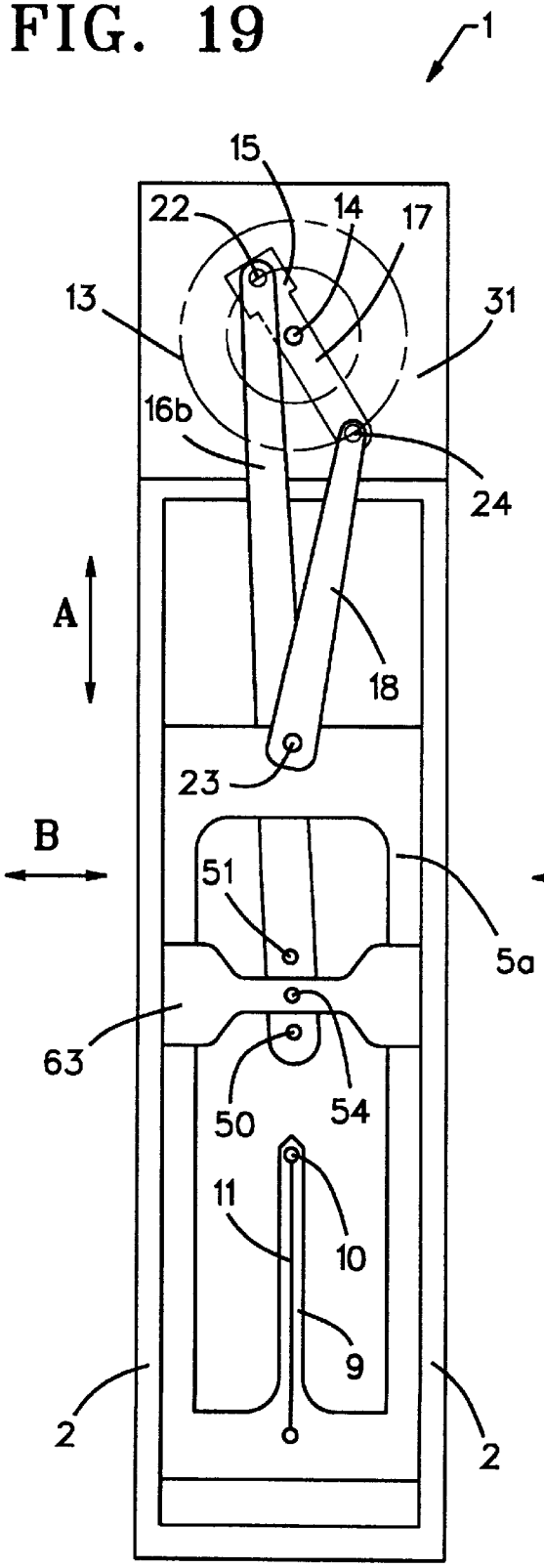
FIG. 19 is an elevation of a further embodiment of a selvage-forming device.

In the embodiment shown in FIG. 19, the yarn guide structure 5*a* corresponds to the yarn guide structure of the embodiment of FIGS. 15 through 18. The coupling bar 16*b* driven by the crank 15 is designed as a yarn guide structure and is fitted with two eyes 50, 51. The coupling rod or bar 16*b* is linked to a yoke-shaped component 63 guided in the longitudinal direction A in linear guides of the side segments 2 of the frame 31. The coupling bar 16*b* is connected by a linkage point 54 to the component 63. The eye 50 is located underneath the linkage point 54 and the eye 51 above it, whereby these two eyes move in mutually opposite directions relative to said linkage point and to the needle 9 when the eccentric drive pivots the coupling bar 16*b*.

Figure 20:
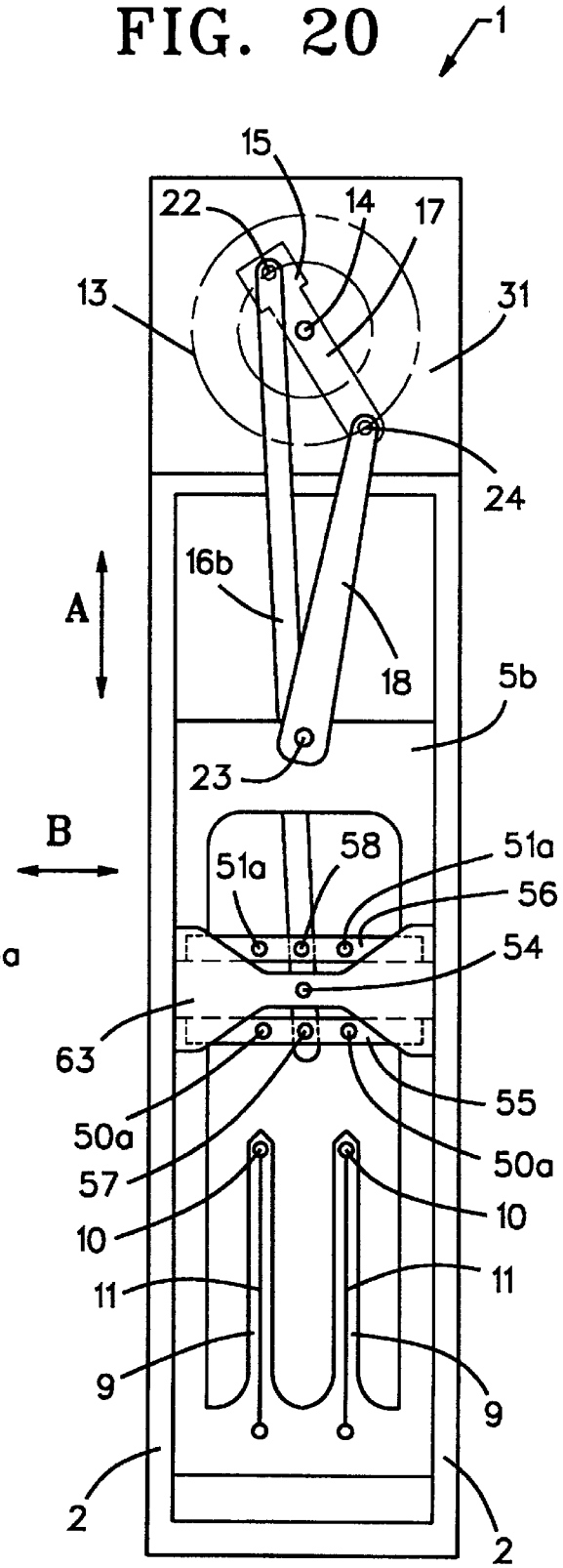
FIG. 20 is an elevation of a selvage-forming device similar to that of FIG. 19, FIGS. 21, 22 show a further embodiment of a selvage-forming device of the invention in two different positions.

The illustrative embodiment of FIG. 20 differs from that of FIG. 19 in that a yarn guide structure 55, 56 is mounted by means of pins 57, 58 resp. to the coupling bar 16*b* above and below the linkage point 54 whereby the coupling bar 16*b* is connected to the yoke-shaped component 63, said yarn guide structure being guided in the transverse direction B. These yarn guide structures are fitted with eyes 50*a*, 51*a* configured on each side of the coupling bar 16*b*. The yarn guide structure 5*b* is fitted with two needles 9 and eyes 10 for two selvage yarns 11, the eyes 50*a*, 51*a* of the yarn guide structures 55, 56 being shiftable in relation to the direction of rotation of the drive shaft 14 to the right or left side relative to said selvage yarns 11.

Figure 21:
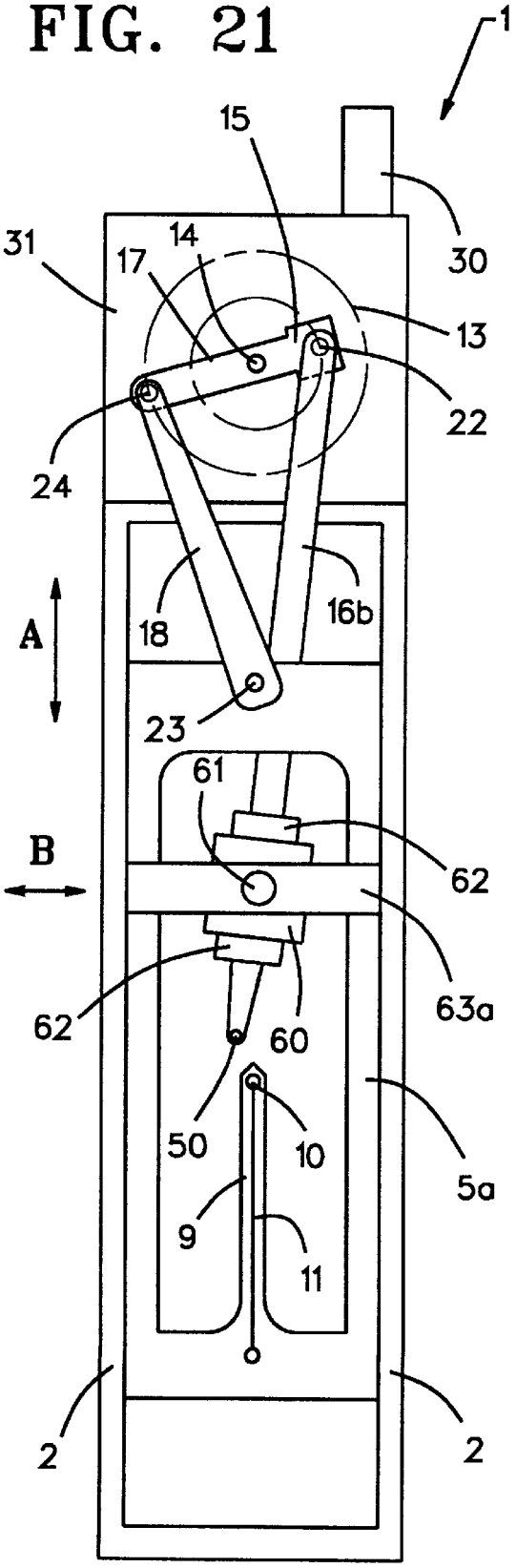
Figure 22:
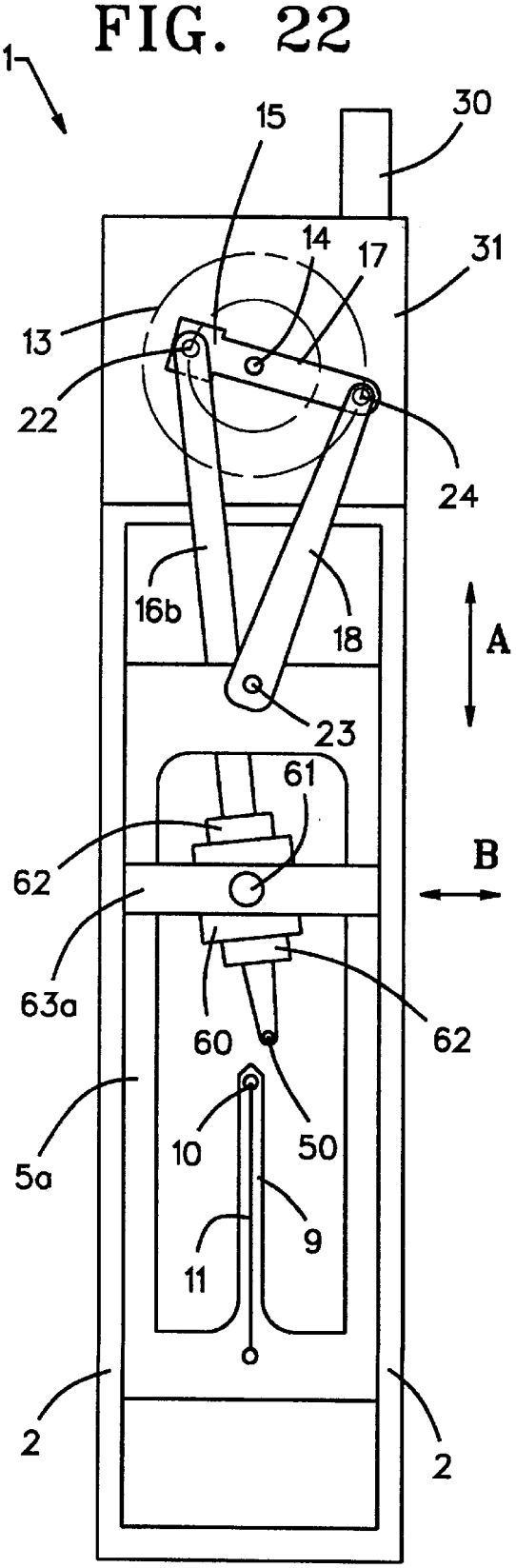

In principle, the embodiment of FIGS. 21 and 22 corresponds to that of FIG. 19. The difference lies in the coupling bar 16*b* being rotatably supported about a shaft 61 by means of a block 60 in a yoke-shaped component 63*a*. The yoke-shaped component 63*a* is guided in the side segments 2 of the frame 31 in the longitudinal direction A inside linear guides, for instance channels. The coupling bar 16*b* is held in the block 60 by securing clamps 62.

Figure 23:
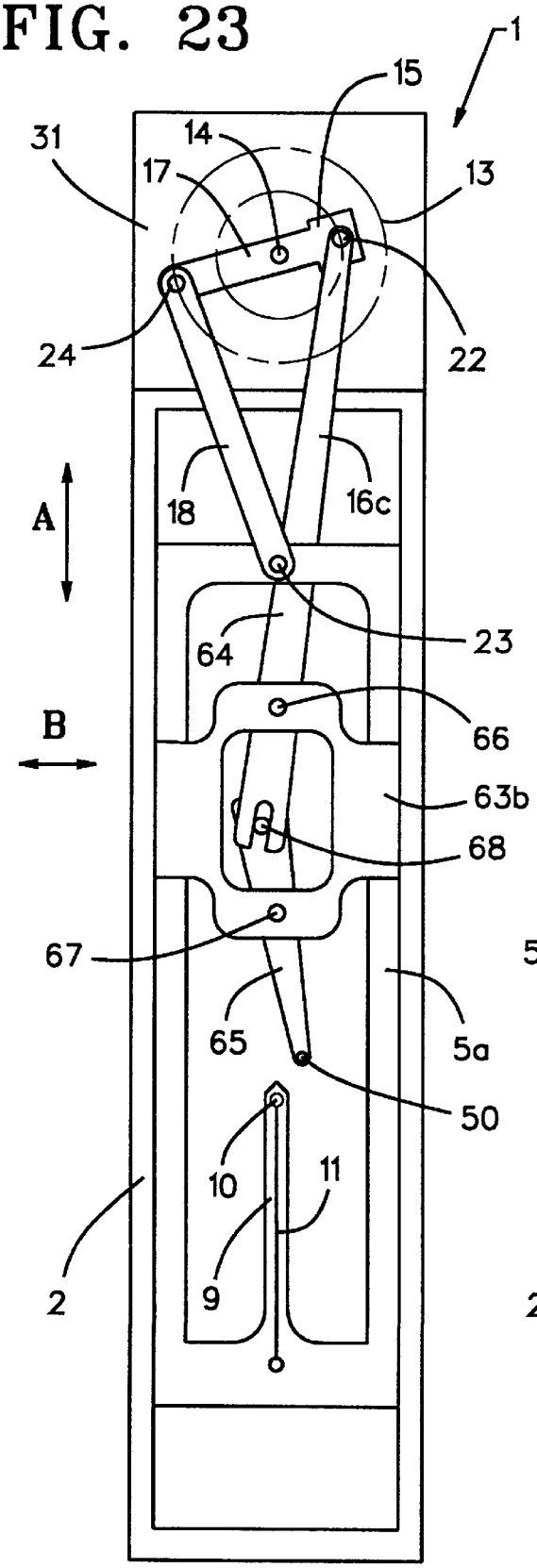
FIGS. 23, 24 show a further embodiment of the invention of a selvage-forming device in two different positions.
Figure 24:
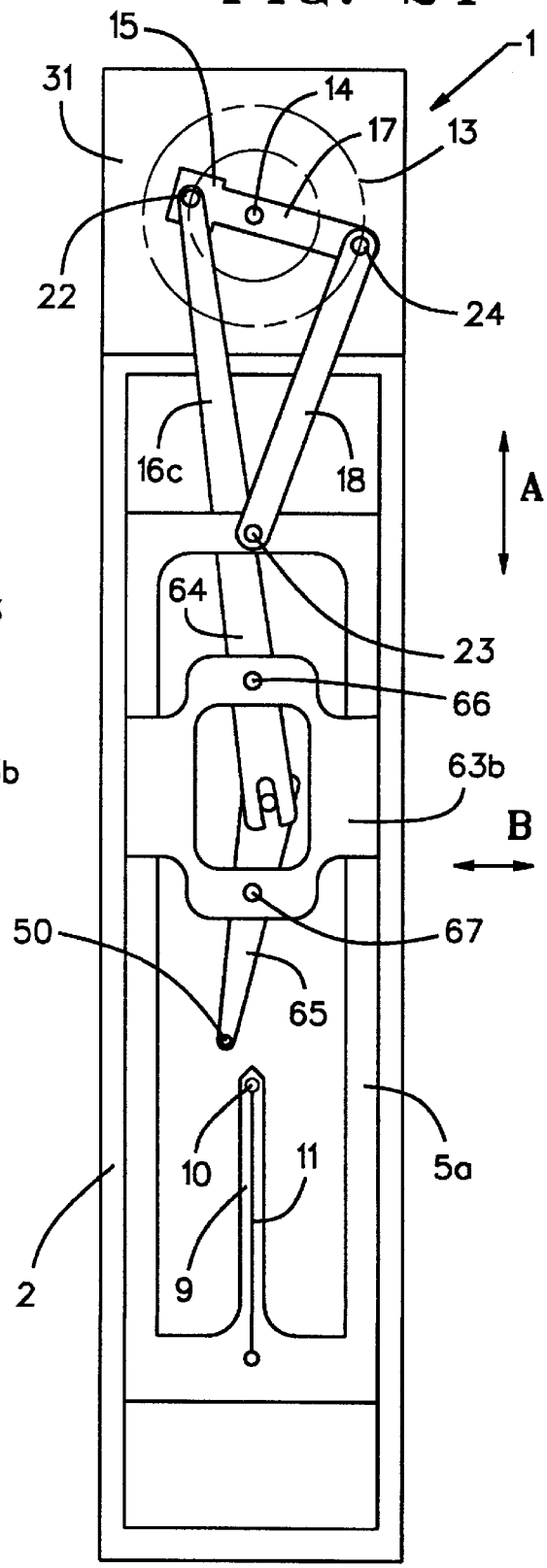

Basically the embodiment of FIGS. 23 and 24 corresponds in its design to that of FIGS. 21 and 22, however the coupling bar 16*c* is designed as a yarn guide and fitted with an eye 50 at its end and is divided into two parts 64, 65. The part 64 is linked by a linkage point 22 to the crank 15 and by a linkage point 66 to a yoke-shaped component 63*b* guided in the longitudinal direction A in linear guides of the side segments 2 of the frame 31. The part 65 is linked a distance away from the linkage point 66 by a linkage point 67 also to the yoke-shaped component 63*b*. The parts 64 and 65 are connected between the two linkage points 66 and 67 by a hinge joint 68 allowing axial compensation, and thereby the part 64 of the coupling bar 16*c* drives the part 65 into pivoting motion corresponding to the pivoting motion of its own. By dividing the coupling bar 16*c* into two parts 64, 65 connected to each other in mutually articulating manner, the motion of the eye 50 in the direction B transverse to the longitudinal direction A can be prescribed independently of the amplitude of the pivoting motion of the part 64 of the coupling bar 16*c*. Depending on the selected positions of the linkage points 66 and 67 and on the position of the hinge joint 68 and the length of the part 65, it is possible to select the transverse displacement of the eye 50 over a given excursion.

All the above discussed embodiments of selvage-forming devices 1 allow different interlacings, i.e. weaves of fillings with selvage yarns 8, 39, 11, the desired weave being attained by controlling the drive 13 by the control 30 according to a selectable pattern. The selected pattern illustratively is such that the position of the drive shaft 14 of the selvage-forming device 1 is determined by the loom's main shaft position and accordingly the position of this drive shaft 14 is synchronous with the motions of the other loom components. Selvage yarns 8, 39, 11 with predetermined weaves can be implemented in arbitrary sequences by controlling the drive element 13 in an appropriately selected manner.

Even though the cranks 15, 17 of the eccentric drives are of different lengths in the above embodiments, they obviously also may be of identical length. Correspondingly, the coupling bars/brackets 16 and 18 of the eccentric drives may be of different or equal lengths. The length of the components is selected in such manner that the shed 12 formed by the selvage yarns 8, 39 and 11 approximately coincides with that shed which is formed by the loom's shed-forming means with omitted warps. For that purpose the selvage-forming device 1 may be mounted by its frame 31 at a suitable loom position. Preferably the component length is selected in such a way that the raised and lowered selvage yarns 8, 39 and 11 will cross in the transverse direction when the pivoting motion of the coupling bracket/bar 16 is at approximately its maximum value. Illustratively the drive element 13 consists of a stepping motor for which the position, speed and acceleration are predetermined by the control unit 30. The stop 29 or 48 is used in this respect to adjust the position of the drive element 13 in known manner using a control program.

Moreover the drive element 13 may consist also of a controlled servomotor. In this case a position sensor 59 as shown in FIG. 16 is required. This position sensor 59 detects the angular position of the drive shaft 14 and feeds it to the control unit 30. If a position sensor 59 is used jointly with a stepping motor, stops obviously no longer are needed. The drive element 13 also may be a hydraulic or pneumatic drive motor. In this design, valves appropriately controlled by the control unit 30 are required.

If the selvage-forming device 1 is mounted inside a frame 31 affixed at an arbitrary location of the loom, then the selvage-forming unit shall be a module connected only by fasteners and electric, pneumatic or hydraulic feeds to the loom.

The selvage-forming device need not mandatorily contain its own control unit 30 because the function of the unit 30 also may be integrated into the loom's control system.

As shown in FIG. 6, a manually operated switch 28 may be associated with the control unit 30 to allow an operator to control the drive element 13 so that the drive shaft 14 assumes a specific angular position whereat the yarn guide structures are easily accessible and can be well cared for.

In the above embodiments, the yarn guiding eyes 10, 50 and 51, 50*a*, 51*a* are shown circular. Obviously they also may assume other shapes, for instance oval or slotted.

All the above embodiments provide that one of the selvage yarns 11 or a set of selvage yarns 11 be raised and lowered in one plane only. Obviously the selvage forming device may be modified in such manner that all selvage yarns shall be displaced relative to each other also in the transverse direction B during the raising and lowering motions used in forming a shed 12. In such a case, eccentric drives must be provided to allow transverse displacement for all selvage yarns raised and lowered in mutually opposite directions.

In the embodiments shown above, the angular range of the drive element 13 is limited, whereby the drive element is alternatingly actuated in both directions of rotation. However the coupling brackets/bars 16 and 18 may also be driven by a crankshaft whereby the drive element 13 need be driven unidirectionally only or illustratively as regards the consecutive insertion of several fillings in one direction of rotation, the direction of rotation then being reversed.

The selvage forming devices of the above embodiments may be used with any kind of loom, that is with jet looms, gripper looms, projectile looms and others.

The invention is not restricted to the above shown and discussed embodiments. Instead many modifications, also combinations of the particular embodiments, may be resorted to. Protection is solely defined by the claims.

We claim:

1. In a selvage forming device for a power loom having a main drive system wherein the selvage forming device includes yarn guide structures movably guided for mutually opposing motions to raise and lower at least two selvage yarns to sequentially form selvage sheds and to periodically cause at least one selvage yarn to periodically cross at least one other selvage yarn in a direction transversely of the raising and lowering direction, the improvement comprising:

a selvage drive motor;

a selvage drive arrangement connected to the yarn guide structures and when actuated driving the structures to periodically raise and lower them with mutually opposing motions and, during such raising and lowering, causing at least one selvage yarn to periodically cross at least one other selvage yarn in a direction transversely of the raising and lowering direction;

said drive arrangement including eccentric drives connected between said selvage drive motor and the yarn guide structures;

said selvage drive motor being independently controllable to vary the motion of the eccentric drives and the yarn guide structures.

2. The improvement as claimed in claim 1, said drive arrangement including a pivot shaft driven in rotation by the selvage drive motor and drivingly connected to said eccentric drives for moving the yarn guide structures, said shaft extending parallel to the principal direction of selvage yarns approaching the selvage shed;

the driving connection between the eccentric drives and the respective yarn guide structures that cause said at least one selvage yarn to periodically cross said at least one other selvage yarn comprising a single coupling bracket/bar (16, 16', 16*a*, 16*b*, 16*c*) connected to both said last-recited yarn guide structures.

3. The improvement as claimed in claim 1, including a rotatable pivot shaft driven in rotation by said selvage drive motor and drivingly connected to said eccentric drives for moving the yarn guide structures, and wherein a pair of said eccentric drives is driven by said pivot shaft via connections located on diametrically opposed sides of said pivot shaft.

4. The improvement as claimed in claim 1, said eccentric drives connected to said selvage drive motor for alternating rotary motion within a range not greater than about 360° of rotation.

5. The improvement as claimed in claim 4, including a stop device located adjacent said selvage drive arrangement and positioned so as to positively limit rotation of said eccentric drives.

6. The improvement as claimed in claim 4, including a position sensor associated with the selvage drive arrangement and arranged to generate position signals indicative of the position of the eccentric drives; and a controller for said selvage drive motor arranged to receive said position signals and to control said drive motor in response to said signals.

7. The improvement as claimed in claim 1, wherein said selvage drive motor is a stepping motor.

8. The improvement as claimed in claim 1, wherein a pair of said yarn guide structures are arranged to cause said at least one selvage yarn to cross at least one other selvage yarn, said pair of yarn guide structures mounted adjacent each other in the direction of yarn motion and including mutually crossing slots (6, 7) together configured for guiding a selvage yarn to be displaced transversely of the raising and lowering directions of the yarn guide structures, to thereby cause the crossing of at least one selvage yarn relative to the other.

9. The improvement as claimed in claim 8, said drive arrangement including a pivot shaft driven in rotation by the selvage drive motor and drivingly connected to said eccentric drives for moving the yarn guide structures; and wherein said pair of selvage yarn guide structures are connected to a common one of said eccentric drives via at least one coupling bracket, the connection points between said at least one coupling bracket and the respective selvage guide structures being arcuately spaced apart relative to the axis of rotation of said pivot shaft.

10. The improvement as claimed in claim 9, wherein the shape of said coupling brackets is selected from the group consisting of Y and T.

11. The improvement as claimed in claim 8, wherein said at least one pair of yarn guide structures is mounted in transversely opposed linear guides.

12. The improvement as claimed in claim 8, wherein each one of said at least one pair of yarn guide structures has opposed end areas and is connected at one end area to an eccentric drive, and including a bracket link pivotally connected to and extending between the other end areas of said yarn guide structures.

13. The improvement as claimed in claim 1, wherein one of said eccentric drives includes a coupling bar (16*a*, 16*b*, 16*c*) that comprises a portion of one of said yarn guide structures.

14. The improvement as claimed in claim 13, including a rotatable pivot shaft drivingly connected to said selvage drive motor and drivingly connected to said eccentric drives for moving said yarn guide structures, and wherein said coupling bar having opposed end areas, is pivotally mounted by a pivot having a pivot axis extending parallel to said pivot shaft to a yoke component guided for up and down motion between said end areas, is connected to a part of one of said eccentric drives at one of said end areas, and has a selvage yarn guide element at the other opposed end area, said one of said eccentric drives arranged so as to cause said connecting bar and yoke component to reciprocate up and down and to pivot about said pivot in response to motion of said one of said eccentric drives.

15. The improvement as claimed in claim 14, wherein said movable yoke component (63) is guided for up and down linear motion.

16. The improvement as claimed in claim 15, including yarn guide elements (55, 56) carried by to said connecting bar (16*b*) at points spaced away from said pivot, with at least one yarn guide element located on each side of said pivot along the length of the connecting bar.

17. The improvement as claimed in claim 13, wherein said coupling bar (16*c*) is formed of a pair of coupling bar portions (64, 65), one of said portions connected to a portion of one of said eccentric drives at one end area thereof and connected by an articulated connection to the other of said coupling bar portions at an opposed end area thereof; said connecting bar portions each pivotally connected by a respective pivot to a yoke component between opposed ends of said connecting portions, said articulated connection located between said pivots, the other of said coupling bar portions including a selvage yarn guide element (50) at an end thereof opposite the end area articulated with the one coupling bar portion.

18. The improvement as claimed in claim 1, wherein one of said yarn guide structures (5, 5*a*, 5*b*) includes at least one yarn guide element (10) at one end area thereof and is connected to one of said eccentric drives at an opposed end area thereof; and including a linear guide element, said one yarn guide structure guided for linear up and down motion in said linear guide structure.

19. The improvement as claimed in claim 18, said one of said yarn guide structures comprising a needle portion extending in a direction parallel to the raising and lowering motion of said yarn guide structure, said yarn guide element located at an end area of said needle portion.

20. The improvement as claimed in claim 19, wherein said one of said yarn guide structures includes at least one selvage yarn eyelet configured to guide a selvage yarn from one side to the opposite side of a portion of said one of said guide structures, said eyelet located at a distance from said selvage yarn guide element between one of said eccentric drives and said selvage yarn guide element.

21. The improvement as claimed in claim 1, said selvage forming device including a frame, and wherein said yarn guide structures and eccentric drives are mounted on said frame.

22. The improvement as claimed in claim 1, said selvage drive arrangement including coupling bracket/bar members having bracket/bar lengths connecting each eccentric drive to a respective yarn guide structure, said coupling bracket/bar members driven by a respective eccentric drive so that they have a maximum pivotal excursion, said selvage drive arrangement including a pivot shaft periodically driven in rotation by the drive motor, and cranks having crank lengths connecting said coupling bracket/bar members to the pivot shaft, said coupling bracket/bar lengths and configurations and said crank lengths and configurations being selected so that the crossing of the selvage yarns will occur at approximately the maximum periodic excursion of the coupling bracket/bar members.

<page_reth value="0" />

* * * * *